US006120027A

United States Patent [19]

Frankel et al.

[11] Patent Number: 6,120,027

[45] Date of Patent: Sep. 19, 2000

[54] RULE BASED TWO/THREE DIMENSIONAL GAME

[76] Inventors: Reuven Frankel, 700 Wilmont, Deerfield, Ill. 60015; Jim Silverstein, 2403 N. Clybourn Ave., Chicago, Ill. 60614

[21] Appl. No.: 09/305,955

[22] Filed: May 6, 1999

[51] Int. Cl.[7] ..... A63F 3/00

[52] U.S. Cl. ..... 273/236; 273/241; 273/271; 273/275; 273/242

[58] Field of Search ..... 273/263, 241, 273/287, 236, 242, 275

[56] References Cited

U.S. PATENT DOCUMENTS 4,339,136 7/1982 Gittings .
4,456,258 6/1984 Lodrick .
5,026,068 6/1991 Weisser .

*Primary Examiner*—Benjamin H. Layno
*Assistant Examiner*—V Mendiratta
*Attorney, Agent, or Firm*—Greer, Burns & Crain, Ltd.

[57] ABSTRACT

A geometrical game of strategy for two or more players in which the object of the game is to form and occupy a series of continuous adjacent polygonal areas. The game is played on a two or three-dimensional playing surface having a series of lines defined thereon. The lines define numerous polygonal areas that are occupied according to predefined rules. Players are afforded sequential turns in which they may occupy an available area or pass to the next player, with players continuing taking turns until all of the areas are occupied.

6 Claims, 8 Drawing Sheets

Fig. 7C
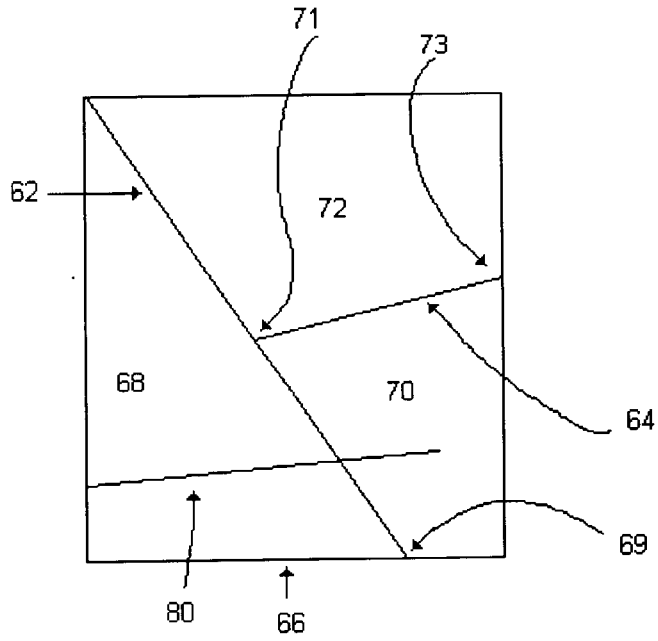
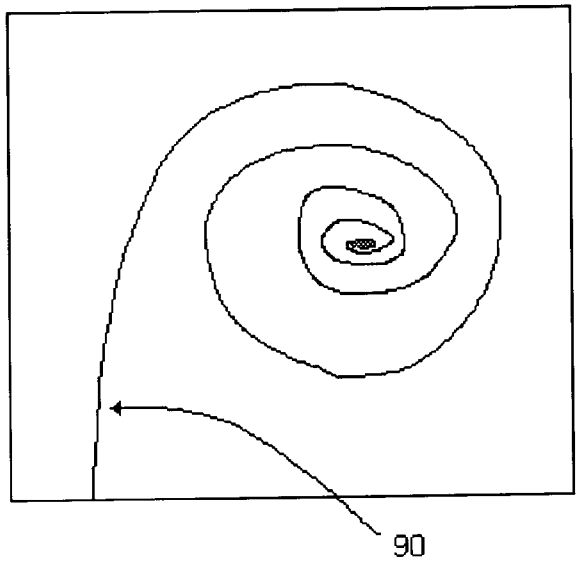
Fig. 8

RULE BASED TWO/THREE DIMENSIONAL GAME

BACKGROUND OF THE INVENTION

Field of the Invention

The present invention relates to a geometrical game of strategy for two or more players which is played on a two or three dimensional playing surface. The object of the game is to accumulate points by capturing areas according to a predetermined set of rules.

BRIEF SUMMARY OF THE INVENTION

The present invention is a game for two or more players, in which players accumulate points by occupying areas according to a predetermined set of rules. The game is played on a bounded two or three dimensional playing surface on which a contiguous arrangement of a plural number of polygonal areas are defined.

Players attempt to form chains by occupying a continuous series of kitty-corner areas. One area is termed to be kitty-corner to another area if two lines selected from among a first group of lines which form the polygon of the first area are also among a second group of lines which form the polygon of the second area. In other words, the two polygons have two common lines. Importantly, the two common lines must intersect, and the first and second areas are adjacent (kitty-corner) only where the two common lines intersect. The most basic chain is formed by two kitty-corner areas, with the number of areas in the chain determining the number of points.

A player may reserve an area by occupying an area kitty-corner to the first area. A reserved area may only be occupied by those players reserving the area. However, an area may be reserved by more than one player.

An area may be occupied by a selected player, provided that the area is not already occupied, and is either not reserved by any player or is reserved by at least the selected player. An area is occupied by marking the area using a pencil, etc. or placing a playing piece on the area. In the case of the game being embodied in software, the areas can be occupied by, for example clicking on a selected area with a pointing device such as a mouse, thereby causing the area to be shaded or color in a unique manner for each player.

According to a first aspect, the game is played on a bounded two or three-dimensional playing surface having a contiguous arrangement of a plural number of polygonal areas defined thereon. The players accumulate points by occupying a series of continuous kitty-corner areas termed chains. The number of areas in a chain determines the number of points awarded.

A first area is kitty-corner to a second area if:

(i) two lines selected from among a first group of lines which form the polygon of the first area are also among a second group of lines which form the polygon of the second area; and (ii) the first and second areas are adjacent only where the two lines intersect.

A selected area is reserved by a player who has selected an area kitty-corner to a given area, wherein an area may be simultaneously reserved by one or more players.

A player may occupy a selected area, using a unique player identifier (playing piece or other visual way of marking an area), provided that the area is not already occupied and the selected area is either:

(i) not reserved; or (ii) is reserved at least by the given player.

Each player has a sequential turn in which the player either occupies an area or passes, and the players continue sequentially taking turns until all of areas are occupied. The winner being determined as the player having a highest total score.

According to a second aspect, areas are grouped into predetermined units, and bonus points are awarded to a player occupying each of the areas of a given unit.

According to a third aspect, the polygonal areas are pre-defined by a predetermined number of lines drawn upon the playing surface. Each line must extend until intersecting with itself, the border or another line.

According to a fourth aspect, the playing surface is initially blank, and each player is assigned a predefined number of lines which he/she may draw on the playing surface during his/her turn. The lines define polygonal areas bounded by selected ones of said lines and the border. The lines are drawn upon the playing surface such that each line cannot cross an already selected area, and each line either:

(i) spans the playing surface; or (ii) terminates at a point in which the selected line intersect with itself or another line;

According to a fifth aspect, the game is embodied in software executed upon on a computer. The game includes a step of displaying a predetermined two or three dimensional playing surface including a contiguous arrangement of a plural number of polygonal areas. The software includes logic for determining that a first area is kitty-corner to a second if:

(i) two lines selected from among a first group of lines which form the polygon of the first area are among a second group of lines which form the polygon of the second area;

(ii) the two lines intersect; and (iii) the first and second areas are adjacent only where the two lines intersect.

The software further includes logic for reserving for a given player each area kitty-corner to an area occupied by the given player, wherein an area is capable of being reserved for more than one player.

A selected area is determined to be available to a given player if the selected area has not been occupied by any player and (i) the selected area is not reserved for any player; or (ii) the selected area is at least reserved by the given player.

The software prompts the players to take sequential turns in which they either pass or occupy an available area. Areas are occupied by selecting an area using a pointing device such as a mouse, thereby causing the area to be marked in a unique manner for each player. Players attempt to accumulate points by occupying a series of continuous kitty-corner areas (chain). A number of points is awarded in relation to the number of areas in the chain, wherein a given area may belong to at most one chain. The players continue taking sequential turns until each area is occupied.

According to a sixth aspect, the game is embodied in software played on a computer. The game includes a step of displaying a blank two or three-dimensional playing surface. Each player is allotted a predetermined number of lines which may be drawn on the playing surface during his/her sequential turn according to predefined rules such that a valid line must be continuous, cannot cross an already selected area, and must (i) span the playing surface; or (ii) terminate at a point in which the line intersect with itself, another line or the border of the playing surface.

Selected ones of the lines placed on the playing surface define polygonal areas.

The software includes logic for determining that a first area is kitty-corner to a second if:

(i) two lines selected from among a first group of lines which form the polygon of the first area are among a second group of lines which form the polygon of the second area;

(ii) the two lines intersect; and (iii) the first and second areas are adjacent only where the two lines intersect.

The software further includes logic for reserving for a given player each area kitty-corner to an area occupied by the given player, wherein an area is capable of being reserved for more than one player.

A selected area is available to a given player if the selected area has not been occupied by any player and (i) the selected area is not reserved for any player; or (ii) the selected area is at least reserved by the given player.

The software prompts the players to take sequential turns in which they either pass, draw a line on the playing surface or occupy an available area. Players attempt to accumulate points by occupying a series of continuous kitty-corner areas termed a chain. A number of points is awarded in relation to the number of areas in the chain, wherein a given area may belong to at most one chain. The players continue taking sequential turns until each area is occupied.

BRIEF DESCRIPTION OF THE DRAWINGS

The game of the present invention will be best understood by reference to the following description of an embodiment of the invention taken in conjunction with the accompanying drawings, in which:

FIG. 7C shows a first example of an invalid two-dimensional playing surface according to a fourth aspect of the present invention;

FIG. 8 shows a second example of an invalid two-dimensional playing surface according to a fourth aspect of the present invention;

DETAILED DESCRIPTION OF THE INVENTION

The preferred embodiments of the present invention will now be explained with reference to the accompanying drawings.

The playing surface of the present invention consists of a bounded two or three dimensional surface. A set of lines are defined on the playing surface, each line spanning the playing surface or ending when it intersects with itself or another line.

Figure 1:
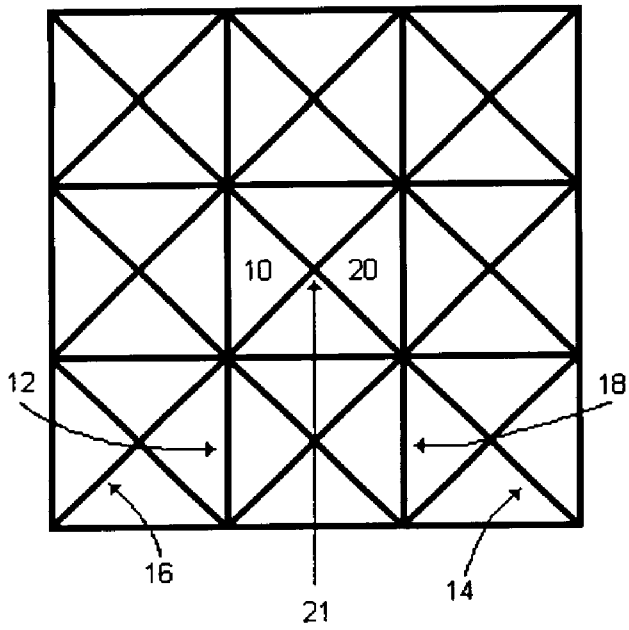
FIG. 1 is a top view of a two-dimensional playing surface according to a first aspect of the present invention.

FIG. 1 shows a sample view of a two-dimensional playing surface. As shown, lines define one or more polygons 10, each of which is termed an area. The object of the game is to accumulate points by forming a continuous series of kitty-corner areas (chain) according to a predetermined set of rules.

Several concepts must be appreciated in order to understand the rules for occupying an area. The first concept relates to when two areas are "kitty-corner" or adjacent to one another.

The lines bounding or defining a given area are known as "bounding lines." Lines 12, 14 and 16 in FIG. 1 are the bounding lines for the area 10, and lines 14, 16 and 18 are the bounding lines for an area 20. Notably, the area 10 shares two bounding lines in common with the area 20, e.g., lines 14 and 16.

One area is considered to be kitty-corner to another area if both areas satisfy the following conditions:

1. The areas share at least two bounding lines which intersect one another; and
2. The two areas are adjacent only where the two bounding lines intersect.

Accordingly, the areas 10 and 20 are kitty-corner because they share the lines 14 and 16, and areas 10 and 20 are adjacent only at a point 21.

Figure 2:
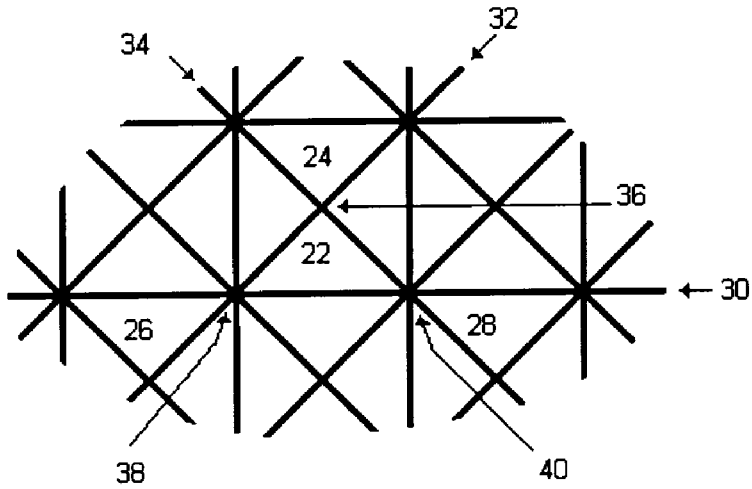
FIG. 2 is an enlarged, fragmentary view of the surface of FIG. 1 depicting kitty-corner areas on a partial two-dimensional playing surface.

An additional example will now be explained with reference to FIG. 2, in which preferably triangular areas 24, 26 and 28 are each kitty-corner to an area 22. In particular, the area 22 has lines 32 and 34 in common with the area 24, and the areas 22 and 24 are adjacent only at a point 36 (intersection of the lines 32 and 34). Similarly, the area 22 has the lines 30 and 32 in common with the area 26, and the areas 22 and 26 are adjacent only at a point 38 (intersection of the lines 30 and 32). Likewise, the area 22 has the lines 30 and 34 in common with the area 28, and the areas 22 and 28 are adjacent only at a point 40 (intersection of the lines 30 and 34).

A three dimensional example of the invention will now be explained with reference to FIG. 3. In the case of a three dimensional playing surface, a line may wrap around the surface. As described previously, each line on the playing surface must either span the playing surface or end when it intersects itself or another line. If the playing surface wraps around to itself, as in the case of a sphere or cube, then any lines placed on that surface must end at either (1) the same point at which they begin; (2) a point at which they intersect another line; or (3) a point at which the line intersects with the border of the playing surface.

Figure 3:
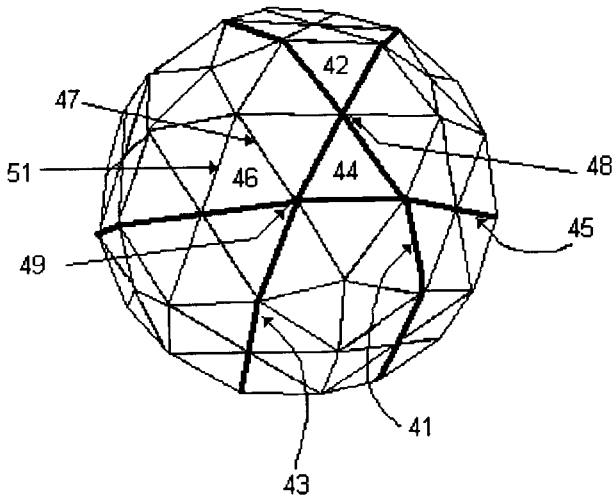
FIG. 3 is a front elevational view of a three-dimensional playing surface.

In the playing surface of FIG. 3, an area 42 is kitty-corner to an area 44. Notably, the area 42 shares lines 41 and 43 in common with the area 44. Moreover, these areas 42, 44 are adjacent only at a point 48 (intersection of the lines 41 and 43).

However, the area 44 is not kitty-corner to the area 46 because these areas do not share two bounding lines. Notably, the area 44 is bounded by the lines 41, 43 and 45, whereas area 46 is bounded by the line 45, and lines 47 and 51.

A second concept of the present invention relates to reservation of an area by a player. Each of the areas which is kitty-corner to a given occupied area are reserved by the player occupying the given area. Thus, referring back to FIG. 2, the areas 24, 26 and 28 which are kitty-corner to area 22 are reserved by the player occupying the area 22. Importantly, a given area may be reserved by more than one player.

Figure 4:
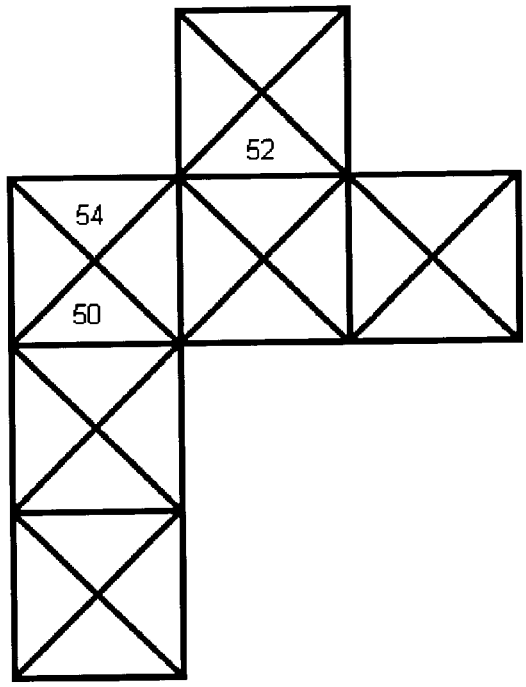
FIG. 4 is a top view of a playing surface depicting reserved areas.

The concept of reservation will be further explained with reference to FIG. 4. Assuming, an initial condition in which none of the areas on the playing surface are occupied except areas 50 and 52, which are occupied by players A and B, respectively. Area 54 is reserved by player A because it is kitty-corner to area 50 occupied by player A. However, area 54 is also reserved by player B because it is kitty-corner to area 52, which is occupied by player B.

A selected player may occupy any unoccupied area on the playing surface subject to the following conditions:

(a) the area not reserved by any other player; or (b) the area is at least reserved by the selected player.

A game according to the present invention requires two or more players. As a preliminary matter, the players select the size and geometry of the playing surface. For example, the players may select a bounded two dimensional playing surface or a bounded three dimensional surface.

After selecting the geometry of the playing surface, the players determine which player goes first by, for example, rolling a die or other like method.

A turn consists of a player occupying an area according to the above-described rules. Players continue taking sequential turns until all of the areas on the playing surface have been occupied.

Figure 5A:
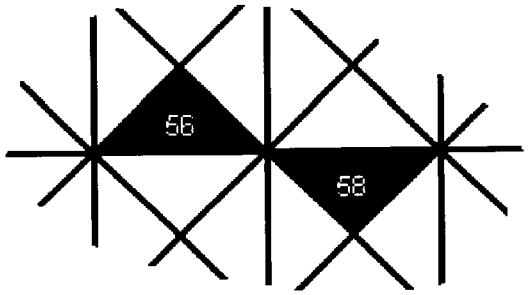
FIG. 5A is an enlarged fragmentary view of a playing surface as seen in FIG. 1 depicting a two area chain.
Figure 5B:
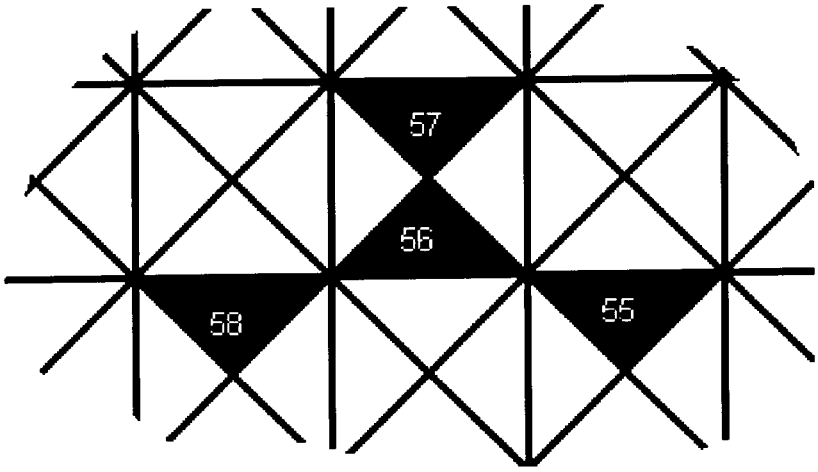
FIG. 5B is an enlarged fragmentary view of a playing surface as seen in FIG. 1 depicting a diagram of a four area chain.

During the game, players attempt to form strings of continuous kitty-corner areas termed chains. The most basic chain is formed of two areas occupied by the same player which are kitty-corner to each other. Thus, areas 56 and 58 (FIG. 5A) occupied by player A form a chain having a length of two areas. Likewise, areas 55–58 (FIG. 5B) occupied by player A form a four area chain. Points are awarded in relation to the number of areas in each chain. An area can only be included in at most one chain. If an area which is occupied by a particular player is adjacent but not kitty-corner to another area owned by the same player, the areas do not form a chain.

The winner is determined at the end of the game by scoring all of the chains that each player has created. Scoring is determined by totaling the squared size of each chain occupied by a given player. For example, a player having three chains X, Y, and Z of continuous areas would be awarded $X^2+y^2+Z^2$ points. The player having the highest score wins.

Figure 6:
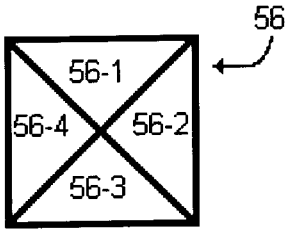
FIG. 6 is a fragmentary illustration of a playing surface as shown in FIG. 1, depicting a unit that is composed of four areas according to a second aspect of the present invention.

According to a second aspect of the present invention, areas are grouped into predetermined units, and bonus points are awarded to a player occupying each of the areas of a given unit. By manner of illustration, in FIG. 6, areas 56-1, 56-2, 56-3 and 56-4 form a unit 56. A player occupying each of the areas 56-1, 56-2, 56-3 and 56-4 may be awarded a number of points equal to a square of the number of areas in that unit, i.e., sixteen points According to a third aspect of the present invention, the initial state of the playing surface includes a predetermined number of polygonal areas. By manner of illustration, FIG. 1 depicts an example of a two-dimensional playing surface according to the third aspect. Similarly, FIG. 3 depicts an example of a three-dimensional playing surface according to the third aspect.

Figure 7A:
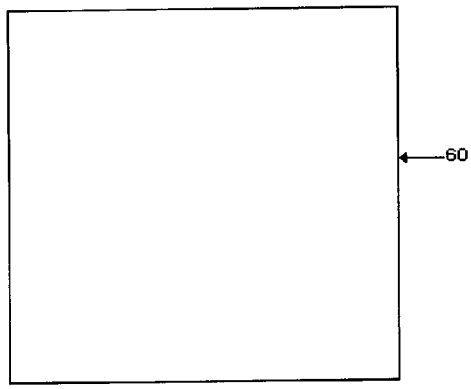
FIG. 7A shows an initial state of a two-dimensional playing surface according to a fourth aspect of the present invention.

A fourth aspect of the invention will now be explained with reference to FIGS. 7A–10. According to this aspect of the game of the present invention, the initial playing surface is blank, i.e., the playing surface is not provided with predefined lines. Rather, each player is allotted a predetermined number of lines which may be placed (marked) on the playing surface during each player's turn. Consequently, a turn consists of a player either placing a line or occupying an area. FIG. 7A depicts an initial condition of a bounded two dimensional playing a surface 60.

Figure 10:
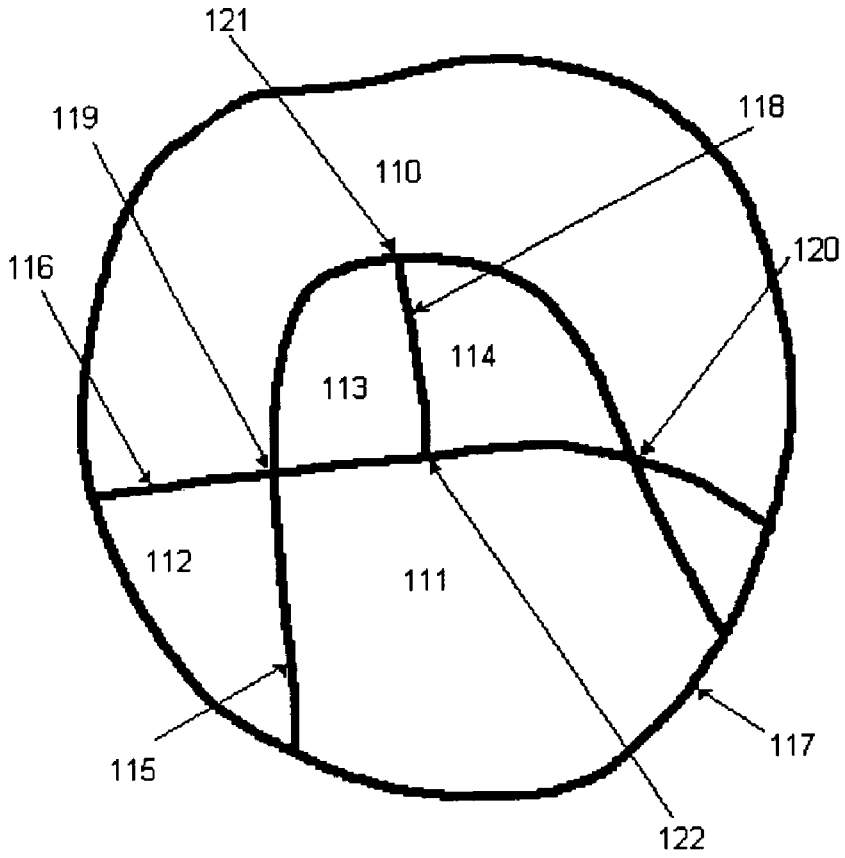
FIG. 10 is a top view of a two-dimensional playing surface according to a third aspect of the present invention.

As described previously, lines placed on the playing surface cannot cross an already selected area, and each line spans the playing surface or continues until it intersects itself or another line. Moreover, lines placed on the playing surface need not be straight lines. Thus, each of lines 115, 116 and 117 in FIG. 10 are valid.

Referring again to FIG. 7B, areas 72 and 70 share lines 62, 64 and 67 which intersect at points 71 and 73, however, they are not considered kitty-corner because they are also adjacent across a line 64. Importantly, areas are only kitty-corner where common lines intersect.

Figure 7B:
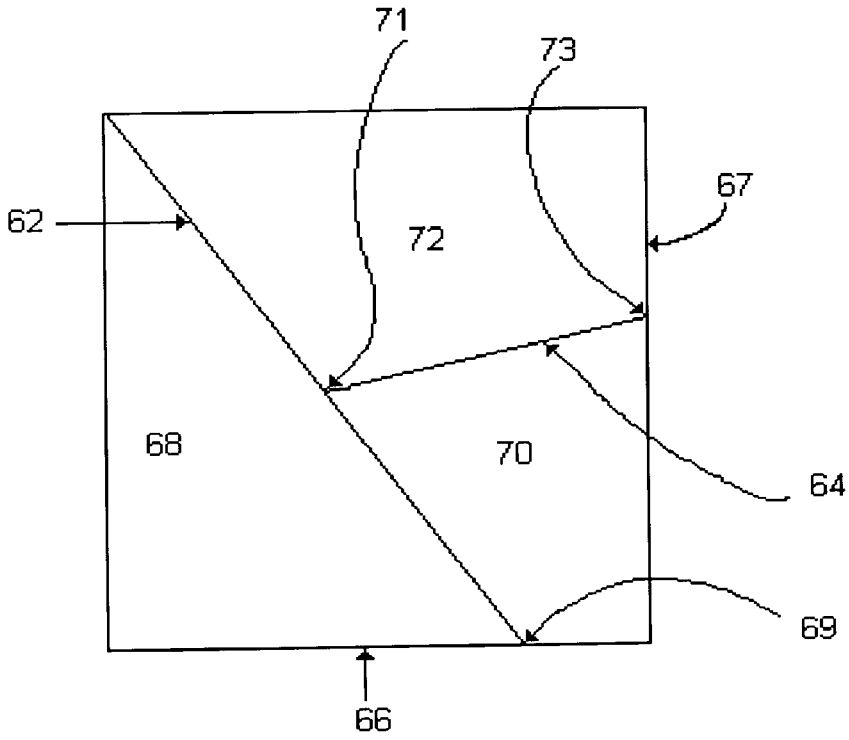
FIG. 7B shows a valid two-dimensional playing surface according to a fourth aspect of the present invention.

FIG. 7C depicts the playing surface of FIG. 7B further including an invalid line 80. Importantly, the line 80 is invalid because it does not stop at the point in which it intersects with the line 62. Rather, invalid line 80 extends past the line 62 into area 70.

Another example of an invalid line is a line 90 in FIG. 8. Notably, a spiral-shaped line 90 is considered invalid because it does not continue until it intersects with itself or another line.

A three-dimensional example according to the fourth aspect of the invention will be explained with reference to FIG. 9. During the game, players place lines on the playing surface. In the case of a three-dimensional playing surface, a line may wrap around the surface. Each line on the playing surface must either span the playing surface or end when it intersects another line or intersects itself. If the playing surface wraps around to itself, as in the case of a sphere or cube, the line may not continue infinitely. An example of an invalid line which continues infinitely is shown in FIG. 8.

Figure 9:
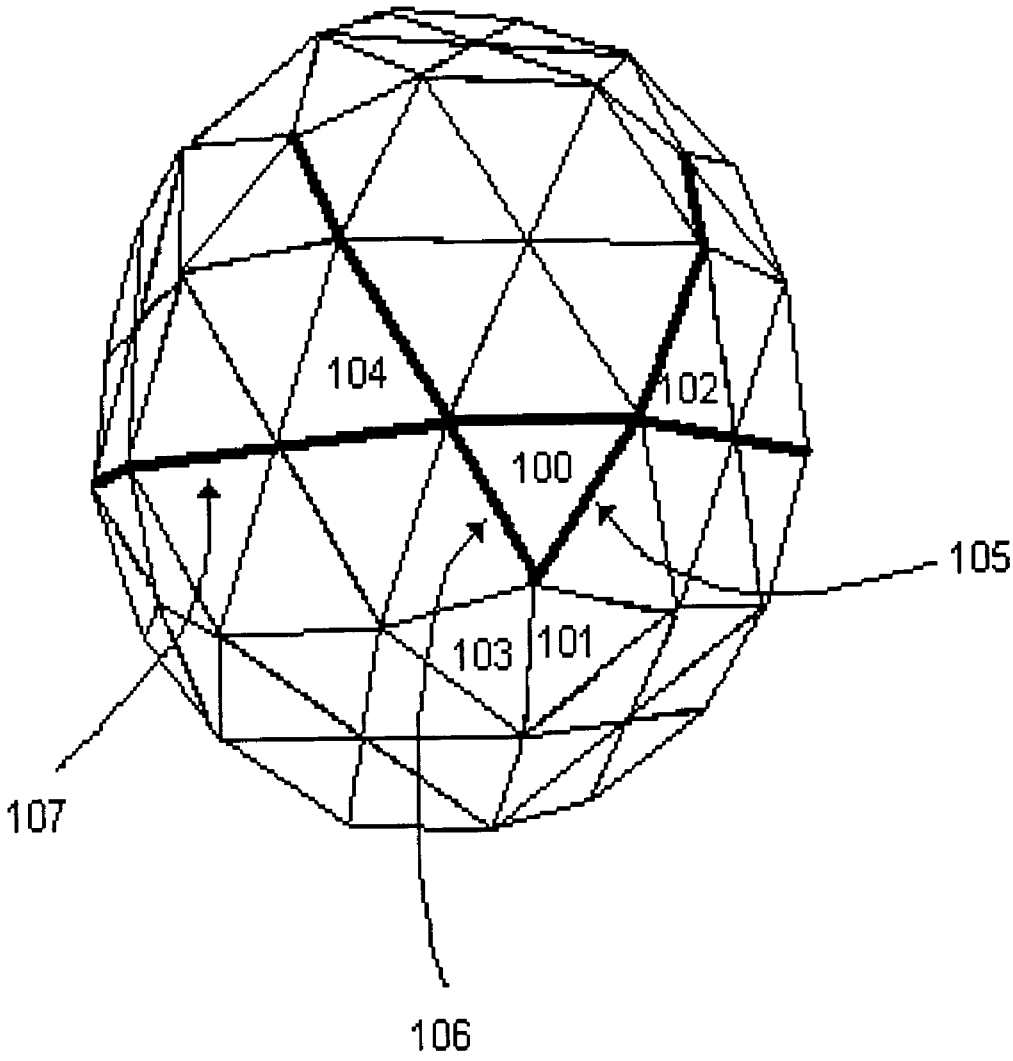
FIG. 9 is a front elevational view of a three-dimensional playing surface according to a third aspect of the present invention.

As shown in FIG. 9, an area 100 is kitty-corner to area 102. However, the area 100 is not kitty-corner to the area 103 because these areas do not share at least two bounding lines.

Another example of the third aspect will be explained with reference to FIG. 10. As described above, according to this aspect of the game, the initial playing surface is not provided with predefined lines. Rather, each player is allotted a predetermined number of lines which may be placed (marked) on the playing surface during each player's turn. As depicted in FIG. 10, lines need not be straight. Rather, a curved line is valid so long as it conforms to the rule that the line is continuous, does not cross an already selected area, and either spans the playing surface or terminates at a point in which the line intersect with itself or another line.

By manner of illustration, FIG. 10 shows a bounded two dimensional playing surface having the valid curved lines 115, 116 and 117. Areas 110 and 111 are bounded by the lines 115, 116 and 117. Notably, areas 110 and 111 are kitty-corner since they are only adjacent where their shared lines intersect, at points 119 and 120.

However, areas 113 and 114 which are bounded by lines 115, 116 and 118, are not kitty-corner. Although they are adjacent where their shared lines intersect at points 121 and 122, they are also adjacent across a line 118, which prevents them from being kitty-corner to each other.

Figure 11:
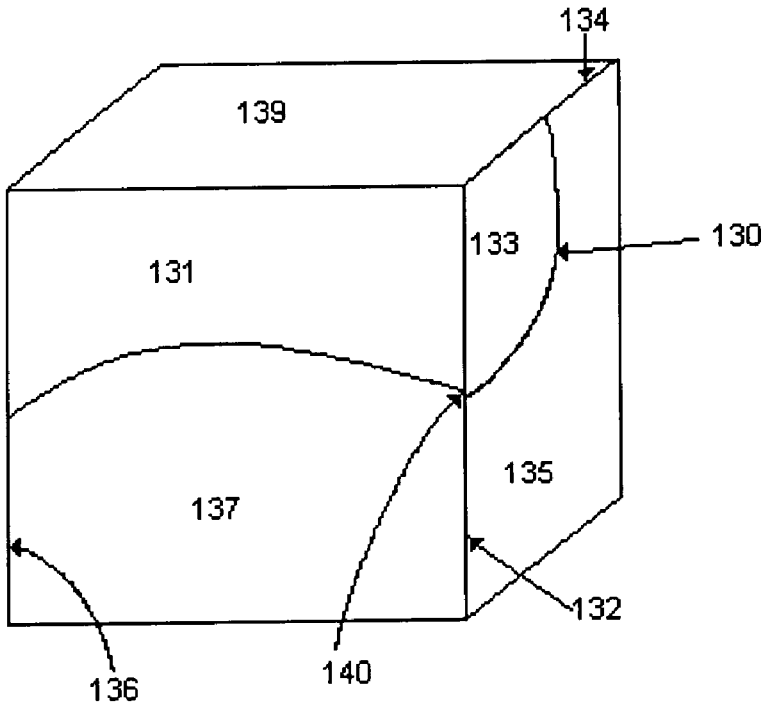
FIG. 11 is a top perspective view of a three-dimensional playing surface according to a third aspect of the present invention.

FIG. 11 shows a three-dimensional, cube shaped, playing surface where a player has placed a line 130, which wraps around two sides of the cube. In the board depicted, areas 133 and 137 are kitty-corner because they share lines 130 and 132, and are adjacent only where the lines 130 and 132 intersect at a point 140.

One of ordinary skill in the art will appreciate that each of the above-described aspects of the game of the present invention may be embodied in software running on a personal computer. Alternatively, such software may be run over the Internet. Moreover, such software may include appropriate logic enabling a user to play against one or more computer-simulated players. Still further, the software may be recorded on a memory storage medium such as a conventional magnetic floppy disk, a CD ROM or like storage medium capable of storing and reproducing executable instructions.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A method for at least two players to play a game on at least one of a bounded two or three-dimensional playing surface including a contiguous arrangement of a plurality of polygonal areas, said method comprising the steps of:

each player alternating turns of occupying selected available areas;

each one of said plurality of polygonal areas may only be occupied by only one player;

a given area of said plurality of polygonal areas being available to a given player provided that said given area is unoccupied and is one of:

(i) not reserved by any other player; or (ii) is at least reserved by said given player;

each unoccupied area kitty-corner to an area occupied by said given player being reserved by said given player, each said unoccupied area may be reserved by several players;

a first said area being kitty-corner to a second said area if:

(i) two lines selected from among a first group of lines which form the polygon of said first area are also among a second group of lines which form the polygon of said second area; and (ii) said first and second areas are adjacent only where said two lines intersect;

wherein the players continue sequentially taking turns until all of the plurality of areas are occupied.

2. The method defined in claim 1, wherein:

an N-length chain is formed by N number of contiguous kitty-corner areas occupied by a given player;

a predetermined number of points being awarded in correspondence to a length of each chain occupied by a given player; and a winner being determined as the player having a highest said total score.

3. The method defined in claim 2, wherein selected areas are grouped into predetermined units and bonus points are awarded to a player occupying each of the areas of a given unit.

4. A method for at least two players to play a game on a predetermined playing surface consisting of a set of lines which cover one of a two or three-dimensional playing surface, each line extending until intersecting with one of itself, a border and another line, plural polygonal areas being bounded by selected ones of the lines and the border, said method comprising the steps of:

assigning each player a means for uniquely identifying selected ones of the plural polygonal areas;

each player alternating turns of occupying a selected available area by marking said selected available area with said identification means;

a given area being available to a given player provided that said given area is unoccupied and is one of:

(i) not reserved by any other player; or (ii) is at least reserved by said given player;

each unoccupied area kitty-corner to an area occupied by said given player being reserved by said given player, each said unoccupied area may be reserved by several players;

a first said area being kitty-corner to a second said area if:

(i) two lines selected from among a first group of lines which form the polygon of said first area are also among a second group of lines which form the polygon of said second area; and (ii) said first and second areas are adjacent only where said two lines intersect;

wherein the players continue sequentially taking turns until all of said plural areas are occupied;

an N-length chain is formed by N-number of contiguous kitty-corner areas occupied by a given player;

a predetermined number of points being awarded in correspondence to a length of each chain occupied by a given player; and a winner being determined as the player having a highest said total score.

5. The method defined in claim 4, wherein areas are grouped into predetermined units, and bonus points are awarded to a player occupying each of the areas of a given unit.

6. A method for at least two players to play a game on a predetermined playing surface consisting of a bounded two or three dimensional playing surface, said method comprising the steps of:

assigning each player a means for uniquely identifying selected ones of the plural polygonal areas;

assigning each player a predetermined number of lines to be placed on the playing surface;

each player sequentially taking turns placing selected ones of the predetermined number of lines on the playing surface until each player has placed all of the predetermined number of lines on the playing surface, the lines being placed on the playing surface such that a selected line must do one of:

(i) span the playing surface; and (ii) terminate at a point in which the selected line intersect with itself or another line;

wherein the lines and the border cooperatively defining plural polygonal areas;

after each player has placed all of the predetermined number of lines on the playing surface, each player takes alternating turns occupying available areas by marking an available one of the plural polygonal areas using the identification means, and the players continue sequentially taking turns until all of the plural polygonal areas are occupied;

a given area being available to a given player provided that said given area is unoccupied and is one of:

(i) not reserved by any other player; or (ii) is at least reserved by said given player;

each unoccupied area kitty-corner to an area occupied by said given player being reserved by said given player, each said unoccupied area may be reserved by several players;

a first said area being kitty-corner to a second said area if:

(i) two lines selected from among a first group of lines which bound the first area are also among a second group of lines which bound the second area; and (ii) the first and second areas are adjacent only where the two lines intersect;

an N-length chain being formed by N number of contiguous kitty-corner areas occupied by a given player;

a predetermined number of points being awarded in correspondence to a length of each chain occupied by a given player; and a winner being determined as the player having a highest said total score.

* * * * *